US005662434A

United States Patent [19]

Khachaturian

[11] Patent Number: 5,662,434

[45] Date of Patent: Sep. 2, 1997

[54] METHOD AND APPARATUS FOR THE OFFSHORE INSTALLATION OF MULTI-TON PREFABRICATED DECK PACKAGES ON PARTIALLY SUBMERGED OFFSHORE JACKET FOUNDATIONS

[76] Inventor: Jon E. Khachaturian, 5827 Rhodes Ave., New Orleans, La. 70131

[21] Appl. No.: 615,838

[22] Filed: Mar. 14, 1996

Related U.S. Application Data

[63] Continuation-in-part of Ser. No. 501,717, Jul. 12, 1995, which is a continuation-in-part of Ser. No. 404,421, Mar. 15, 1995.

[51] Int. Cl.[6] ..... E02B 17/00

[52] U.S. Cl. ..... 405/204; 405/209

[58] Field of Search ..... 405/204, 209, 405/203, 196; 114/264, 265

[56] References Cited

U.S. PATENT DOCUMENTS

| | | | |
|---|---|---|---|
| 2,598,088 | 5/1952 | Wilson | 61/46 |
| 3,977,346 | 8/1976 | Natvig et al. | 114/65 R |
| 4,242,011 | 12/1980 | Karsan et al. | 405/204 |
| 4,249,618 | 2/1981 | Lamy | 405/204 X |
| 4,252,468 | 2/1981 | Blight | 405/204 |
| 4,252,469 | 2/1981 | Blight et al. | 405/204 |
| 4,714,382 | 12/1987 | Khachaturian | 405/204 |
| 4,744,697 | 5/1988 | Coppens | 405/204 |
| 5,037,241 | 8/1991 | Vaughn et al. | 405/209 |

*Primary Examiner*—Hoang C. Dang
*Attorney, Agent, or Firm*—Pravel, Hewitt, Kimball & Krieger

[57] ABSTRACT

A method and apparatus for the installation or removal of large multi-ton prefabricated deck packages includes the use of usually two barges defining a base that can support a large multi-ton load. A variable dimensional truss assembly is supported by the barge and forms a load transfer interface between the barge and the deck package. End caps are removably connected to each of a two diagonally extending, longitudinal members of a boom portion of the truss assembly. Upper and lower connections form attachments between the end caps and the deck package at the upper elevational positions on the deck package. Tensile connections form attachments between the deck package and barge at a lower elevational position. The variable dimension truss includes at least one member of variable length, in the preferred embodiment being a winch powered cable that can be extended and retracted by winding and unwinding the winch.

17 Claims, 11 Drawing Sheets

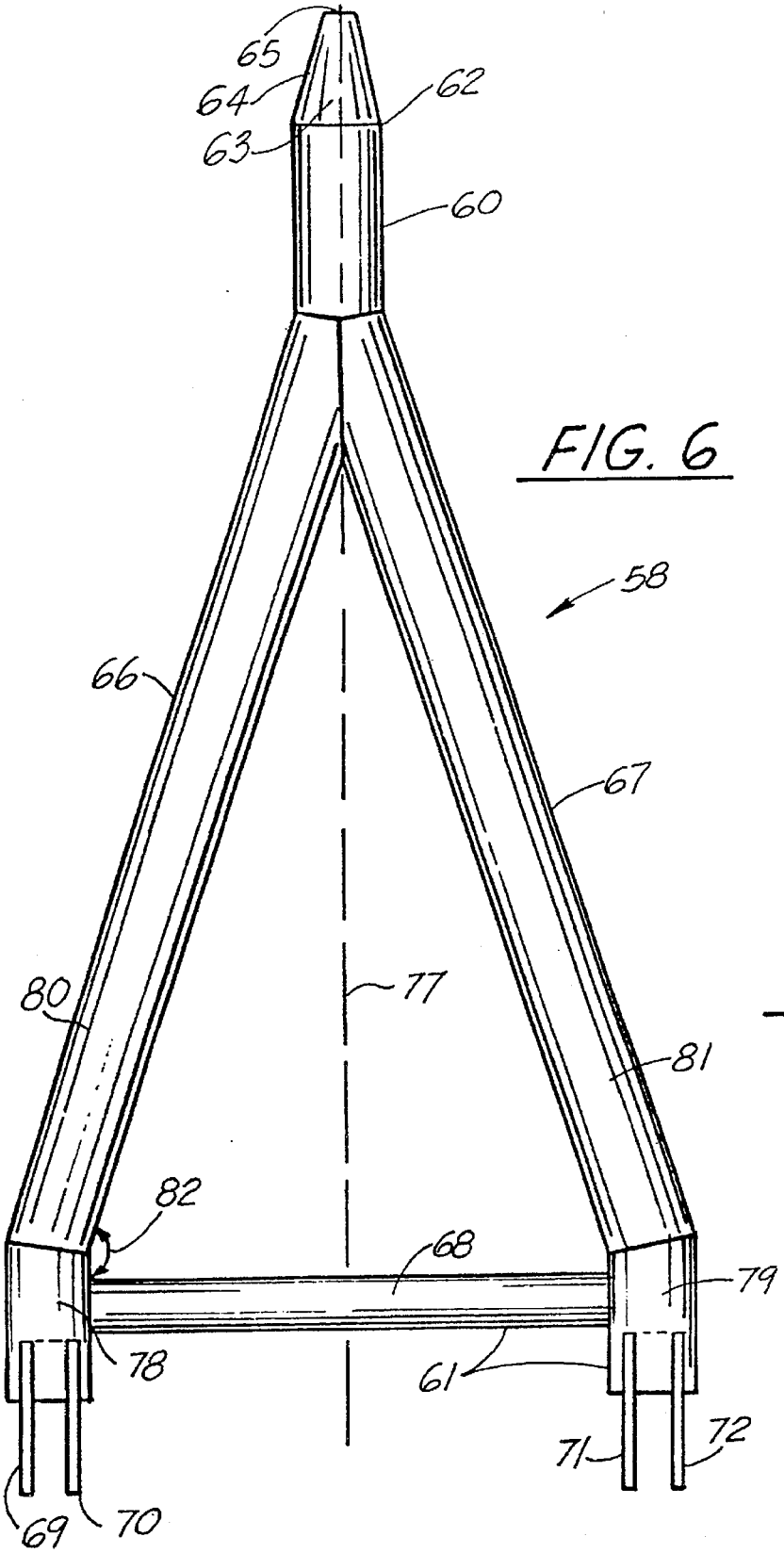
FIG. 6
FIG. 7
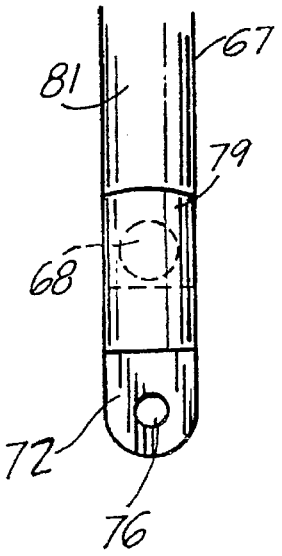

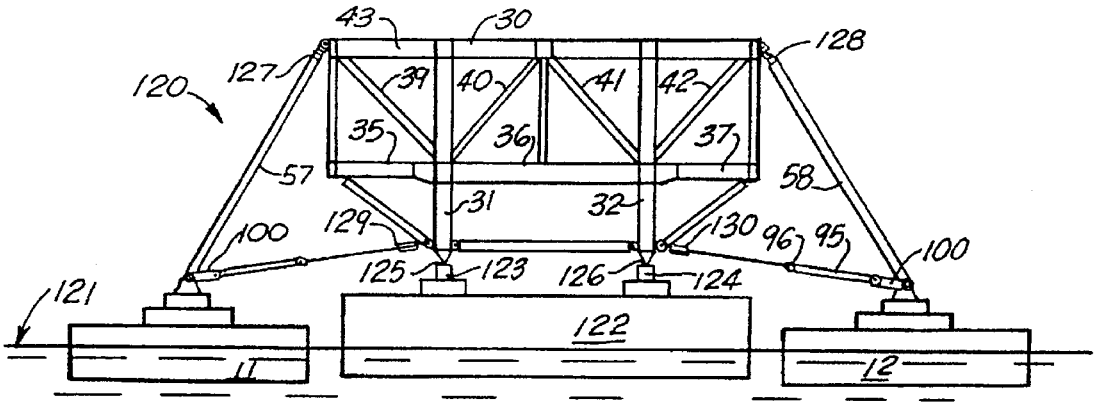
FIG. 13
FIG. 14
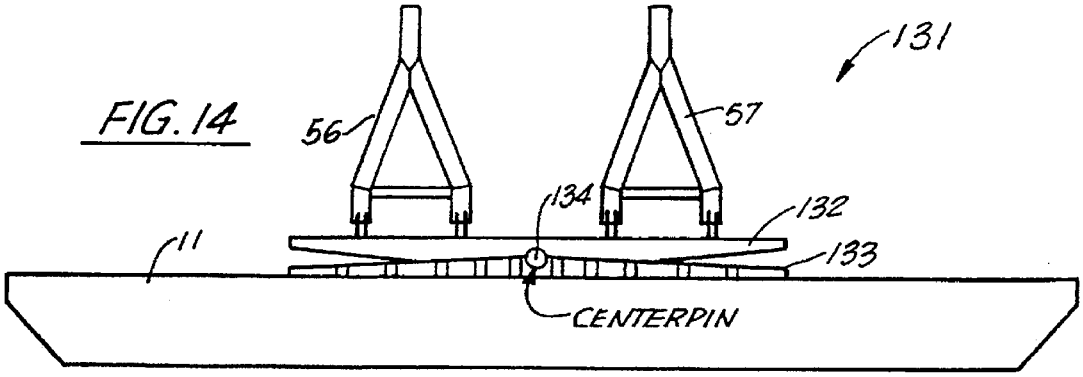
FIG. 15
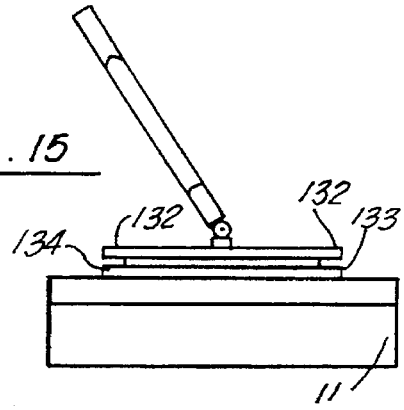
FIG. 16
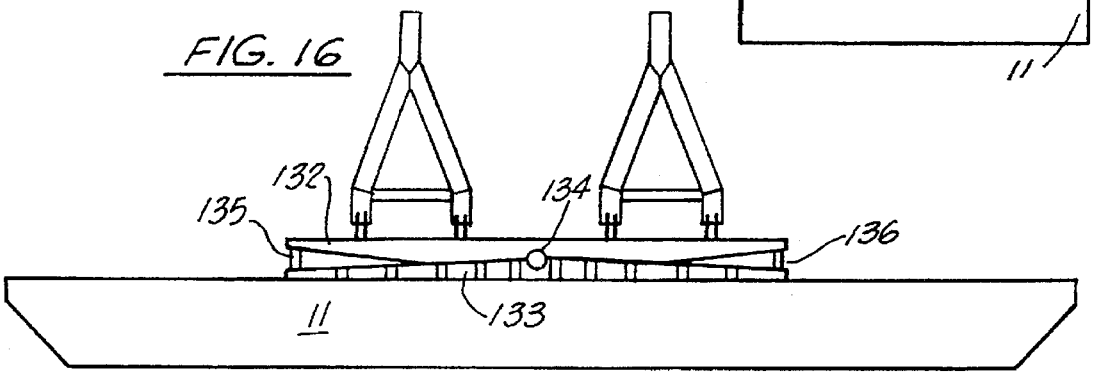

METHOD AND APPARATUS FOR THE OFFSHORE INSTALLATION OF MULTI-TON PREFABRICATED DECK PACKAGES ON PARTIALLY SUBMERGED OFFSHORE JACKET FOUNDATIONS

CROSS REFERENCE TO RELATED APPLICATIONS

This is a continuation-in-part of copending U.S. Pat. application Ser. No. 08/501,717, filed Jul. 12, 1995, which is a continuation-in-part of U.S. application Ser. No. 08/404,421 filed Mar. 15, 1995, each of which is hereby incorporated herein by reference.

BACKGROUND OF THE INVENTION

1. Field of the Invention

The present invention relates to the placement of large multi-ton prefabricated deck packages (e.g. oil and gas platforms, oil rigs) in an offshore environment upon a usually partially submerged jacket that extends between the seabed and the water surface. Even more particularly, the present invention relates to the use of a moving lifting assembly which is preferably barge supported that can place a very large deck package upon an offshore marine jacket foundation without the use of enormous lifting booms such as form a part of derrick barges, offshore cranes, and the like, and wherein a "quick connect" connection is formed between the lifting assembly and the deck package.

2. General Background

In the offshore oil and gas industry, the search for oil and gas is often conducted in a marine environment. Sometimes the search takes place many miles offshore. Oil and gas well drilling takes place in many hundreds of feet of water depth.

The problem of drilling oil wells offshore and then producing these wells has been solved in part by the use of enormous fixed or floating platform structures with foundations that are mostly submerged, but usually extending a number of feet above the water surface. Upon this foundation (or "jacket", tension leg platform ("TLP"), or SPAR, etc. as it is called in the art) there is usually placed a very large prefabricated rig or deck platform. The term "deck platform" as used herein should be understood to include any of a large variety of prefabricated structures that are placed on an offshore foundation to form a fixed or floating offshore platform. Thus, a "deck-platform" can include, e.g. a drilling rig, a production platform, a crew quarters, living quarters, or the like.

As an example of one offshore foundation, a supporting jacket is usually a very large multi-chord base formed of multiple sections of structural tubing or pipe that are welded together. Such jackets have been used for a number of years for the purpose of supporting large deck platforms in an offshore environment.

The jacket or foundation is usually prefabricated on land in a fabrication yard, preferably adjacent to a navigable waterway. The completed jacket can be placed upon a large transport barge so that it can be moved to the drill site where it will be placed upon the ocean floor. As an example, an offshore jacket can be several hundred feet in length. The size of the jacket is of course a function of the depth of water in which the rig will be placed. A five hundred (500) foot water depth at the drill site (or production site) will require a jacket which is approximately 500–550 feet tall. The jacket is usually partially submerged, with only a small upper portion of the jacket extending slightly above the water surface. An offshore jacket as described and in its position on the seabed can be seen, for example, in the Blight, et al U.S. Pat. No. 4,252,469 entitled "Method and Apparatus for installing integrated Deck Structure and Rapidly Separating Same from Supporting Barge Means." Specifically, FIGS. 1, 2 and 3 of the Blight, et al patent show an offshore jacket on the seabed.

A small upper portion of the jacket extends above the water surface. This exposed portion of the jacket is the portion upon which the "deck platform" is placed and supported by. This upper portion of the jacket is usually equipped with a number of alignment devices which enhance the proper placement of the deck package on the jacket. Such alignment devices are referred to variously as stabbing eyes, sockets, or the like. The use of such alignment devices, sockets, or stabbing eyes can be seen in the Blight, et al U.S. Pat. Nos. 4,252,468 and 4,252,469 as well as in the Kansan U.S. Pat. No. 4,242,011. For purposes of background and reference, the Kansan U.S. Pat. No. 4,242,011 is incorporated herein by reference. The Blight, et al U.S. Pat. Nos. 4,252,469 and 4,252,468 are likewise each incorporated herein by reference.

Deck platforms or topsides can be extremely large and have correspondingly heavy weights. For example, it is not uncommon for a deck platform such as a drilling rig crew quarters, production platform or the like to be between five hundred and five thousand (500 and 5,000) tons gross weight. Topsides in excess of ten thousand (10,000) tons have been installed, and others that are being planned may weigh as much as thirty thousand (30,000) tons. Such enormous load values present significant problems in the placement of deck platforms on offshore jacket structures. First, the placement is done entirely in a marine environment. While the jacket can be laid on its side and/or floated into position, the platform is not a submersible structure, and must be generally supported in an upright condition above the water surface to prevent water damage to the many components that form a part of the drilling or production platform (such as electrical systems, wall constructions, and other portions that will be inhabited by individuals and used as oil and gas well drilling or production equipment).

The art has typically used enormous derrick barges for the purpose of setting or placing deck packages on jackets in an offshore environment. These derrick barges are large, rectangular barge structures with a high capacity lifting boom mounted at one end portion of the deck of the barge. The barge, for example might be three hundred to four hundred (300–400) feet in length, fifty to seventy five (50–75) feet in width, and twenty-five to fifty (25–50) feet deep. These figures are exemplary.

A derrick barge might have a lifting capacity of for example, two thousand (2,000) tons. For very large structures such as for example, a five thousand (5,000) ton deck package, two derrick barges can be used, each supporting one side portion of the deck platform with a multi-line lift system supported by an enormous structural boom extending high into the air above the package during the lift.

The boom simply works in the same way as an anchor lifting boom, namely the loadline raises and/or lowers the package into its proper position upon the jacket. While the use of such derrick barges has been very successful in the placing of offshore deck packages on jackets through the years, such derrick barges are generally limited in their capacity to packages of two thousand (2,000) tons or less. Further, derrick barges of such an enormous capacity are extremely expensive to manufacture and operate. Many thousand of dollars per hour as a cost of using such a device is not uncommon. Although there are five (5) or six (6) derrick barges that can lift in excess of six thousand (6,000) tons, they are extremely costly and limited as to the water depth in which they can operate.

However, when very large loads of, for example six thousand—ten thousand (6,000–10,000) tons are involved, the limitation of the derrick barge usually prohibits such a placement on an offshore jacket. The topside must then be pieced and finished offshore.

In U.S. Pat. No. 4,714,38 issued to Jon Khachaturian there is disclosed a method and apparatus for the offshore installation of multi-ton prefabricated deck packages on partially submerged jacket foundations. The Khachaturian patent uses a variable dimensional truss assembly that is supported by the barge and forms a load transfer interface between the barge and the deck package. Upper and lower connections form attachments between the truss members and the deck package at upper and lower elevational positions on the deck package. The variable dimension truss includes at least one member of variable length, in the preferred embodiment being a winch powered cable that can be extended and retracted by winding and unwinding the winch. Alternate embodiments include the use of a hydraulic cylinder as an example.

An earlier patent, U.S. Pat. No. 2,598,088 issued to H. A. Wilson entitled "Offshore Platform Structure and Method of Erecting Same" discusses the placement of drilling structure with a barge wherein the legs of the drilling structure are placed while the drilling structure is supported by two barges. The Wilson device does note use truss-like lifting assemblies having variable length portions which are placed generally on opposite sides of the deck package. Rather, Wilson relates to a platform which is floated in place and the support legs are then placed under the floating platform. Thus, in the Wilson reference, an in-place underlying supporting jacket is not contemplated.

The Natvig, et al U.S. Pat. No. 3,977,346 discusses a method of placing a deck structure upon a building site such as a pier. The method includes the pre-assembly of a deck structure upon a base structure on land so that the deck structure extends outwardly over a body of water. Floating barges are provided for supporting the deck structure outwardly of the building site. The deck structure is then transferred to the supportive base structure by means of barges. The Natvig reference uses two barges which are placed on opposite sides of a platform with pedestal type fixed supports forming a load transfer member between the barges and the platform. However, the fixed pedestal of Natvig are unlike the truss-like lifting arrangement of applicant which include movable portions at least one of which can be of a variable length.

SUMMARY OF THE INVENTION

The present invention provides an improved method and apparatus for the placement of a multi-ton deck package on an offshore jacket or other partially submerged foundation. Also the present invention provides an improved method and apparatus for the removal of a multi-ton deck package from an offshore jacket. The present invention discloses an improvement to the variable dimension truss assembly disclosed in U.S. Pat. No. 4,714,382 incorporated herein by reference. The apparatus includes one or more barges defining a base that supports the large multi-ton load of the deck package.

In the preferred embodiment, a horizontally extending truss is mounted on each side of the deck package to be lifted during operation.

In the preferred embodiment, two barges are used respectively, each having a preferably variable dimension lift truss on its upper deck surface. The truss preferably includes a member of variable length so that the cross-sectional dimensions of the truss can be varied.

The truss forms thus a load transfer between each barge and the deck package to be lifted and placed. Upper and lower connections are formed between the lifting truss and the deck package at respective upper and lower elevational positions.

Power is provided, preferably in the form of a winch mounted on the barge for changing the length of the variable length member of the truss so that elevational position of the deck package with respect to the barge can be varied such as during a lowering of the deck package to the jacket foundation.

In the method of the present invention, the multi-ton deck package is first transported on a transport barge to the site where it will eventually assist in the drilling oil and/or production of a well.

In the preferred embodiment, a lifting assembly is attached to the deck package on generally opposite sides of the deck package and at upper and lower positions.

One element of the truss-like lifting assembly preferably includes a moveable portion which has a variable length. In the preferred embodiment, the movable portion is a winch powered cable which can be extended or retracted between the lift barge and the deck package being lifted.

In the preferred embodiment, two lift barges support respectively a pair of truss-like lifting assemblies which in combination with the deck package form an overall truss arrangement. That is, the deck package itself forms a portion of the truss during the lift, and may carry both compression and tension loads.

The truss-like lifting assemblies thus support the deck package and elevate it above the surface of the transport barge so that the transport barge can be removed as a support for a deck package. This allows the deck package to be placed vertically above the jacket or partially submerged foundation and aligned with the foundation so that the deck package can be placed upon the foundation by lowering.

With the present invention, this allows a dimensional change in the cross-sectional configuration of the truss with respect to a vertical cross section of the truss and provides a means of raising and lowering the deck package.

As an improvement, the present invention provides a quick release arrangement that allows the lifting barges and the lifting boom attached thereto to very quickly attach to or disengage from the deck package being lifted.

The present invention allows a very quick connection to be formed between the multi-ton prefabricated deck package and the variable dimension truss assembly supported upon the barges.

The present invention allows a quick disconnect of the prefabricated multi-ton deck package and the lifting boom portion of the variable dimension truss as soon as the deck package has been properly placed upon the jacket.

An improvement in the method of the present invention involves the use of quick connect fittings that attach the diagonally extending lifting boom portion of the present invention to an upper connection with the deck package being lifted.

The present invention provides an improved boom arrangement that includes a three dimensional lifting boom having a generally "A-frame" shape with selectively adjustable length members.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 6 is a fragmentary view of the preferred embodiment of the apparatus of the present invention illustrating the lifting boom portion thereof;

FIG. 7 is a fragmentary view illustrating a portion of the lifting book of FIG. 6;

FIG. 13 is an elevational view of an alternate embodiment of the apparatus of the present invention;

FIG. 14 is an elevational view of a second alternate embodiment of the apparatus of the present invention;

FIG. 15 is a side elevational view of the second embodiment of the apparatus of the present invention;

FIG. 16 is a front elevational view of the second embodiment of the apparatus of the present invention showing the optional stop used to rigidify the apparatus if calm c-states exist;

DETAILED DESCRIPTION OF THE PREFERRED EMBODIMENT

Figure 1:
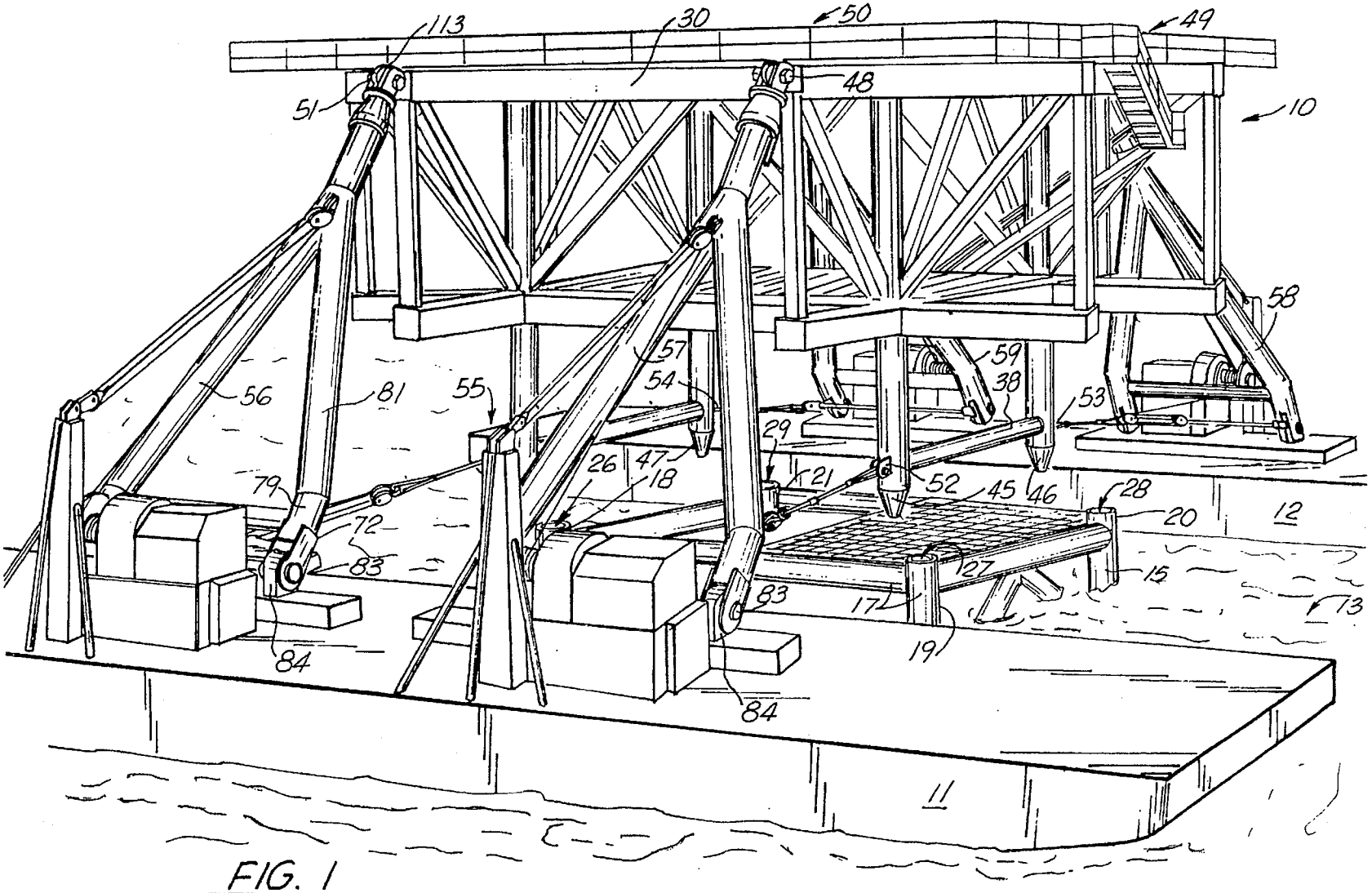
FIG. 1 is a perspective view of the preferred embodiment of the apparatus of the present invention illustrating the deck package being supported in an elevated position above the jacket to which the platform will be attached.
Figure 2:
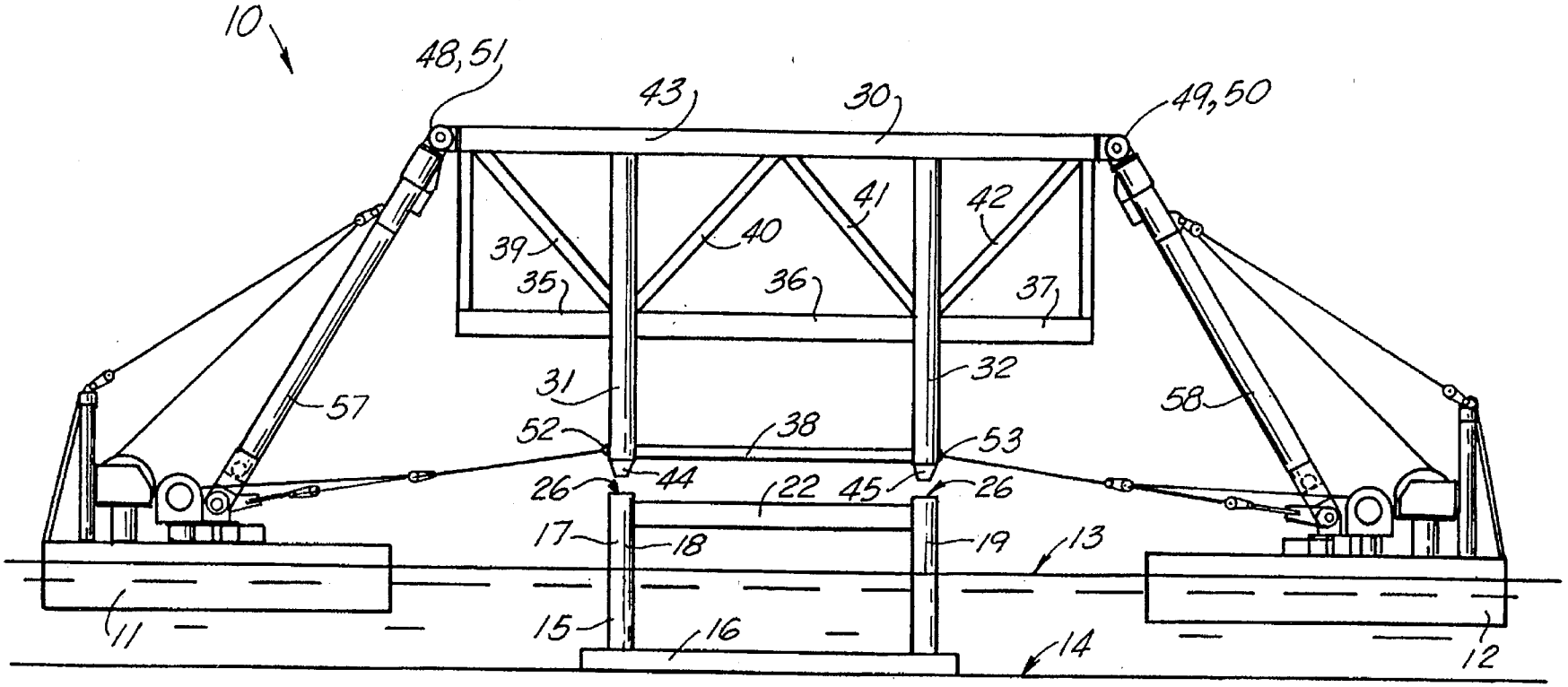
FIG. 2 is an elevational view of the preferred embodiment of the apparatus of the present invention immediately prior to placement of the deck package on jacket.
Figure 3:
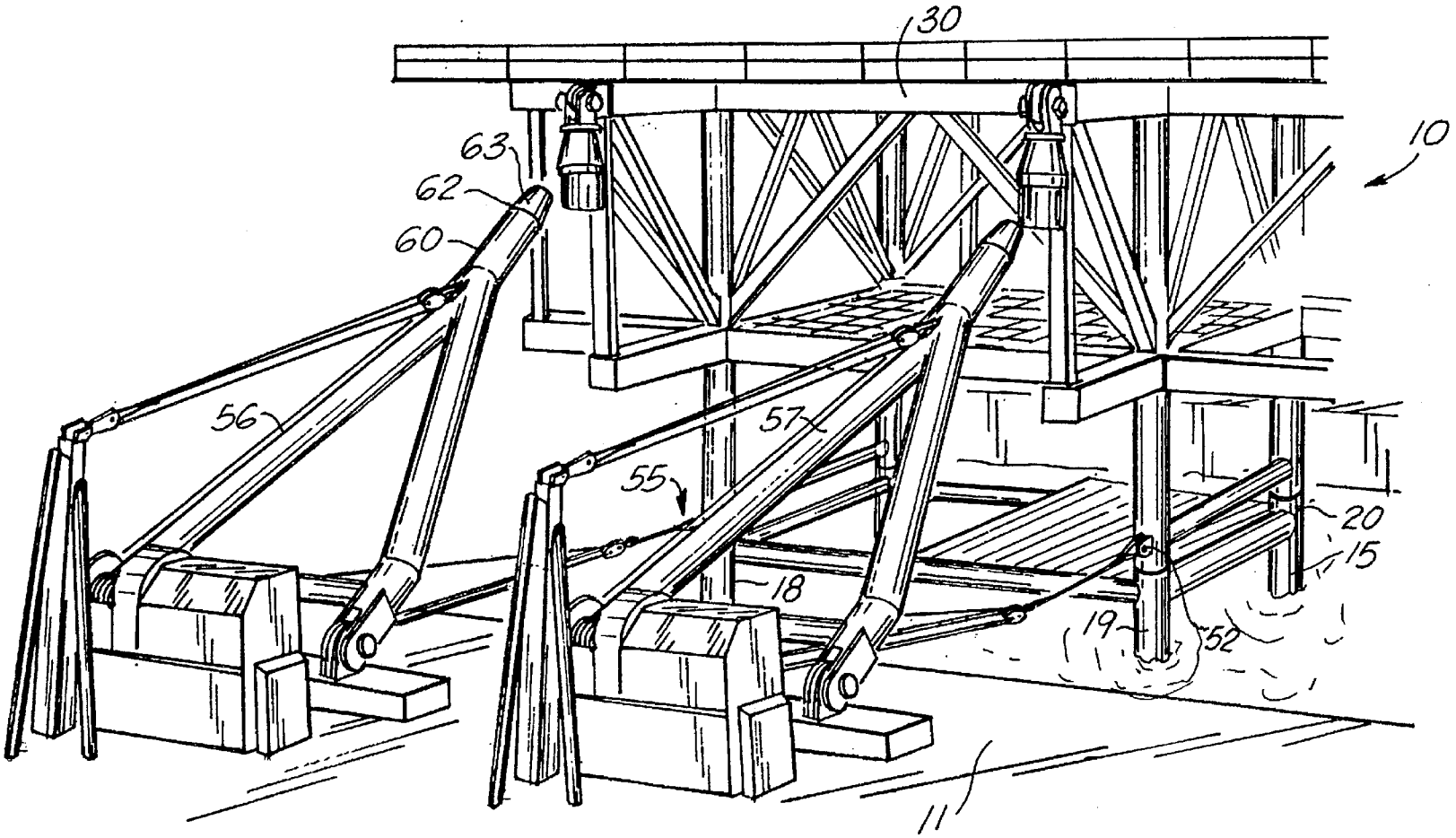
FIG. 3 is a perspective view of the preferred embodiment of the apparatus of the present invention illustrating the deck package in an assembled, installed position upon the jacket and showing a disengaged position of the lifting booms and deck package.

FIGS. 1–3 show generally the preferred embodiment of the apparatus of the present invention designated generally by the numeral 10. Lifting apparatus 10 uses a pair of floating barges 11, 12 to lift a deck package or platform 30. In FIGS. 1–4, each of the barges 11, 12 is preferably a floating type marine barge that floats upon the water surface 13. Barges 11,12 can be standard size marine barges measuring seventy two (72) feet wide and two hundred fifty (250) feet long or fifty four (54) feet wide and one hundred eighty (180) feet long.

For purposes of reference, FIG. 2 shows water surface 13, the seabed 15, and a jacket 15 that is placed on the seabed 14 and which extends above the water surface 13. Jackets 15 are known in the art. The construction of jacket 15 is conventional and known. Jacket 15 typically includes a base 16 that is in some fashion mounted to the seabed 14. The jacket 15 also has an exposed portion 17 that extends above the water surface 13. Jacket 15 can include a plurality of coles 18–21 extending above the water surface 13. Jacket 15 can also include a number of horizontal members 22 that extends between the columns 18–21. Diagonal members (not shown) can also be used to provide reinforcement for jacket 15 as is known in the art.

Figure 4:
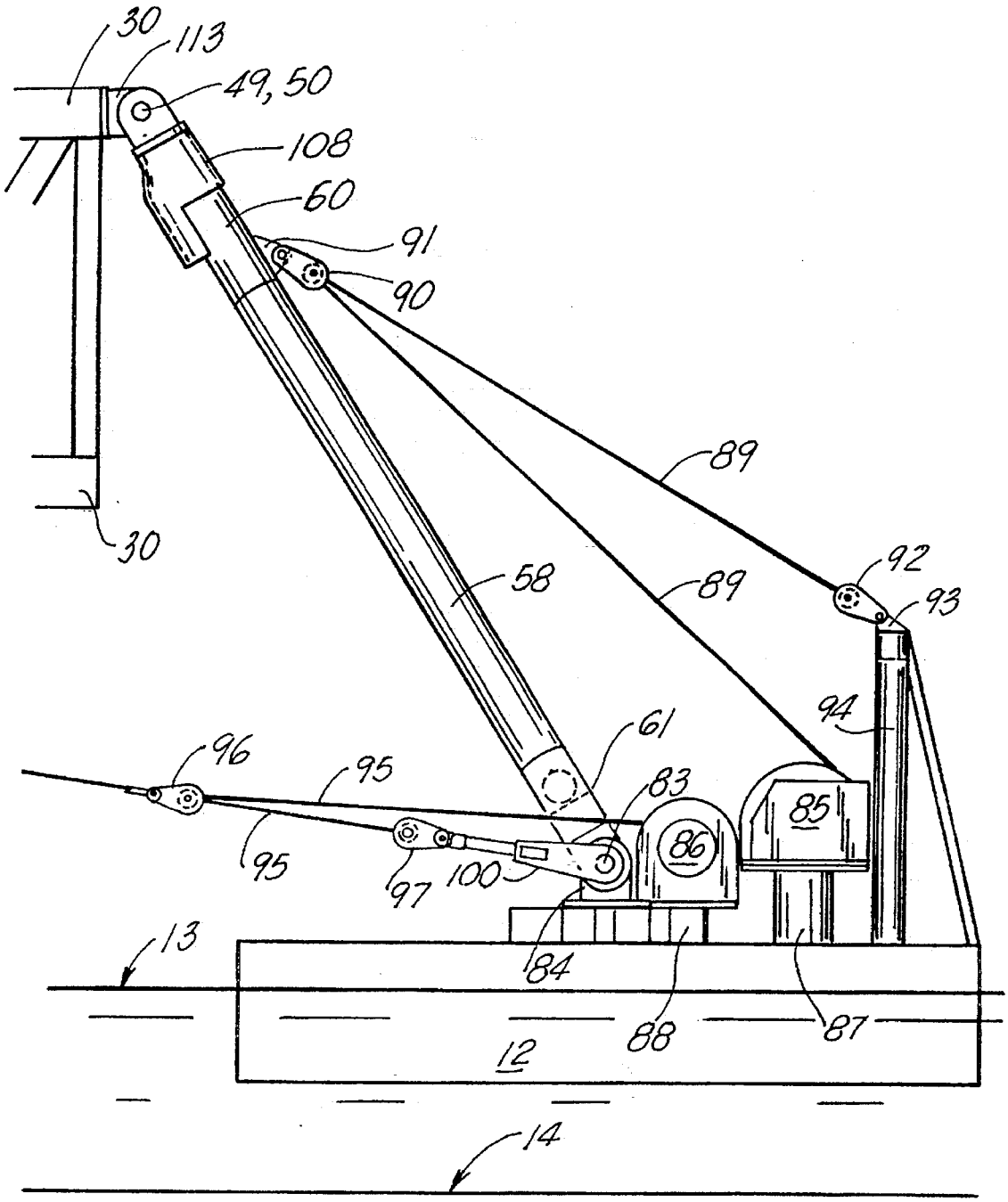
FIG. 4 is a partial elevational view of the preferred embodiment of the apparatus of the present invention illustrating the barge, lifting boom, winches, backstay and cable rigging for one barge.

Each of the columns 18–21 provides a corresponding socket 16–19. The sockets 16–19 receive the lower end portion of the deck package 30 upon assembly. Deck package 30 includes a plurality of columns 31–34, a plurality of horizontal members 35–38, and diagonal members 39–42 as shown in FIG. 4. Typically, such deck packages 30 are prefabricated in a fashion known in the art. Deck packages 30 usually provide an upper expansive structurally reinforced horizontal deck 43 that carries equipment, crew quarters, oil well drilling equipment, oil and gas well production equipment, drilling or production supplies and the like. The lower end portion of deck package 30 includes a plurality of conically shaped projections 44–47 that are sized and shaped to fit the sockets 26–29 of jacket 15.

In order to place deck package 30 on jacket 15, lifting apparatus 10 of the present invention is preferably attached to the deck package 30 after the deck package 30 has been floated to the site of jacket 15 using a transport barge or the like. In order to lift the deck package 30 from its transport barge, upper and lower connections are formed between each barge 11, 12 and the deck package 30 to be lifted as will be described more fully hereinafter. In FIGS. 1–3, a plurality of four upper connections 48–51 are made. In FIGS. 1–4, a plurality of lower connection 52–55 are perfected.

In order to lift the deck package 30, each barge 11–12 is provided with a plurality of lifting booms 56–59. In the preferred embodiment, a pair of lifting booms 56–57 are placed on the barge 11. A pair of lifting booms 58–59 are placed on the barge 12. In FIGS. 4 and 6–7 one of the, the lifting booms 56 is shown in more detail. It should be understood that each of the lifting booms 56–59 is of substantially identical construction, configuration and size as that shown for boom 58 in FIGS. 4 and 6–7. Therefore, only one lift boom 58 is discussed and described in those FIGS. 4 and 6–7.

Lifting boom 58 includes an upper portion 60 that will form a releasable, quick-connect connection with the deck package 30. Lifting boom 58 also includes a lower end portion 61 that is connected with a pinned connection to the barge 11. The upper portion 60 of lifting boom 58 provides a free end 62 having a tip 63. The tip 63 includes a frustroconical outer surface 64 and a flat end portion 65. Each end portion 62 connects to a corresponding socket of a bell connector 108 mounted on the package 30 to be lifted.

Each boom 56–59 is comprised of a pair of boom longitudinal members 66–67 and boom transverse member 68. Each boom 56–59 attaches to its barge 11, 12 using booms padeyes 69–72, each padeye having a corresponding circular opening 73–76 that receives a cylindrical pin 83. A plurality of correspondingly shaped deck padeyes 84 are provided on the barge 11 so that a pinned connection can be formed between the padeyes 69–71 of each boom 56–59 and the padeyes 84 of the respective barge 11 or 12 using a cylindrical pin 83 (see FIGS. 1–4).

Reference line 77 in FIGS. 6 and 7 is the central longitudinal axis of upper cylindrical portion 60 of each lifting boom 56–59. Reference line 77 is also perpendicular to the central longitudinal axis of boom transverse member 68. Each of the padeyes 69–72 is preferably a flat padeye member that is parallel to reference line 77. Similarly, each deck padeye 84 is a flat plate member that is parallel to reference line 77. Pin 83 is perpendicular to reference line 77.

Longitudinal members 66–67 each include short and long portions. The boom longitudinal member 66 includes short sections 78 and long section 80. The boom longitudinal member 66 includes short section 79 and long section 81. An obtuse angle 82 is formed between each of the short sections 78, 79 and its respective long section 80, 81. In FIGS. 1–4 and 5, there can be seen a pair of winches 85, 86. Each winch 85, 86 can be a commercially available winch such as the Skaggitt RB90 or Amcom 750. Such winches are very powerful, having a single line pull of about one hundred fifty thousand (150,000) pounds for example. Sheaves are then used to increase the overall horizontal pulling capacity of the system as required from job to job.

Each winch 85, 86 is structurally mounted to its respective barge 11, 12 with a pedestal. Winch 85 is mounted upon pedestal 87. Winch 86 is mounted upon pedestal 88.

In FIG. 4, the winch 85 is wound with an elongated cable 89 that is routed through sheave 90 and sheave 92 as many times as necessary to develop the capacity to raise or lower the respective boom 56–59 for quick connection. A padeye 91 is mounted at the upper end 60 of lift boom 58 as shown in FIG. 4. Sheave 90 mounts to padeye 91 as shown. The sheave 92 is mounted upon padeye 93 at the upper end of backstay 94. The winch 85 as rigged in FIG. 4 can be used to raise and lower the desired lift boom 56–59 as the particular lift boom 56–59 rotates about pin 83. However, during actual lifting of the deck package 30, the cable 89 is not required and is slack until time of disconnection.

Figure 5:
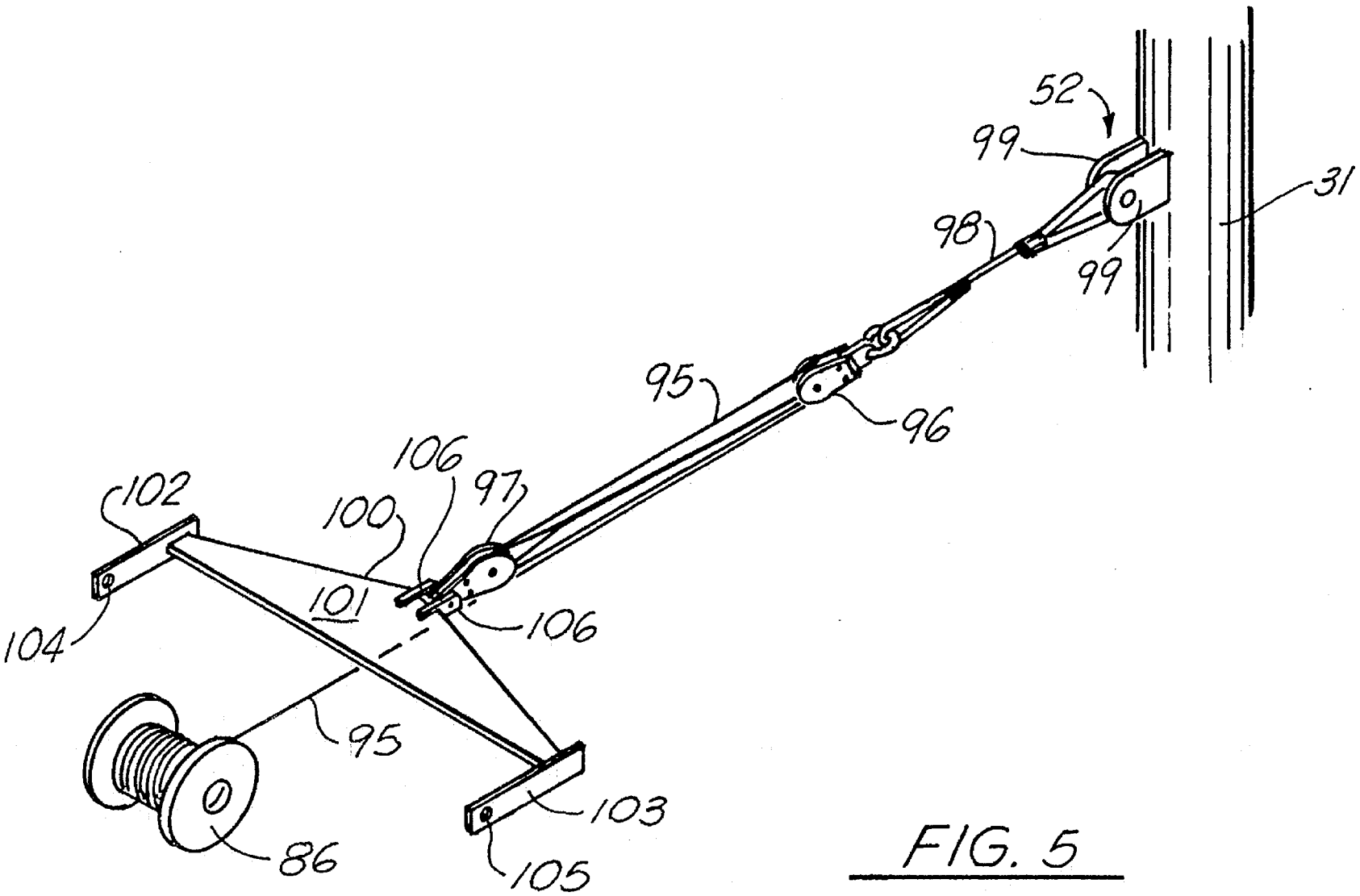
FIG. 5 is a partial perspective view of the preferred embodiment of the apparatus of the present invention illustrating portion of rigging.

Winch 86 is mounted upon pedestal 88. The winch 86 has an elongated cable 95 wound upon the winch. The cable 95 is rigged to sheave 96 and sheave 97. The sheave 96 connects to the rig package 30 at the above described lower connections 52–55. In FIG. 5, a typical rigging between winch 86 and a vertical column 31 of platform 30 is shown. The winch 86 is wound with the elongated cable 95 that is routed through the sheaves 96 and 97 as many times as necessary to develop the load required to lift deck package 30. Sling 98 can be sized to carry the entire load. The sheave 96 attaches to sling 98. The sling 98 is attached to padeyes 99 mounted on vertical column 31 of platform 30. The sheave 97 is attached to spreader plate 100 at padeye 106, each having an opening 107 for receiving a pin so that the user can form a connection between the sheave 97 and the plate 100 at padeyes.

Figure 8:
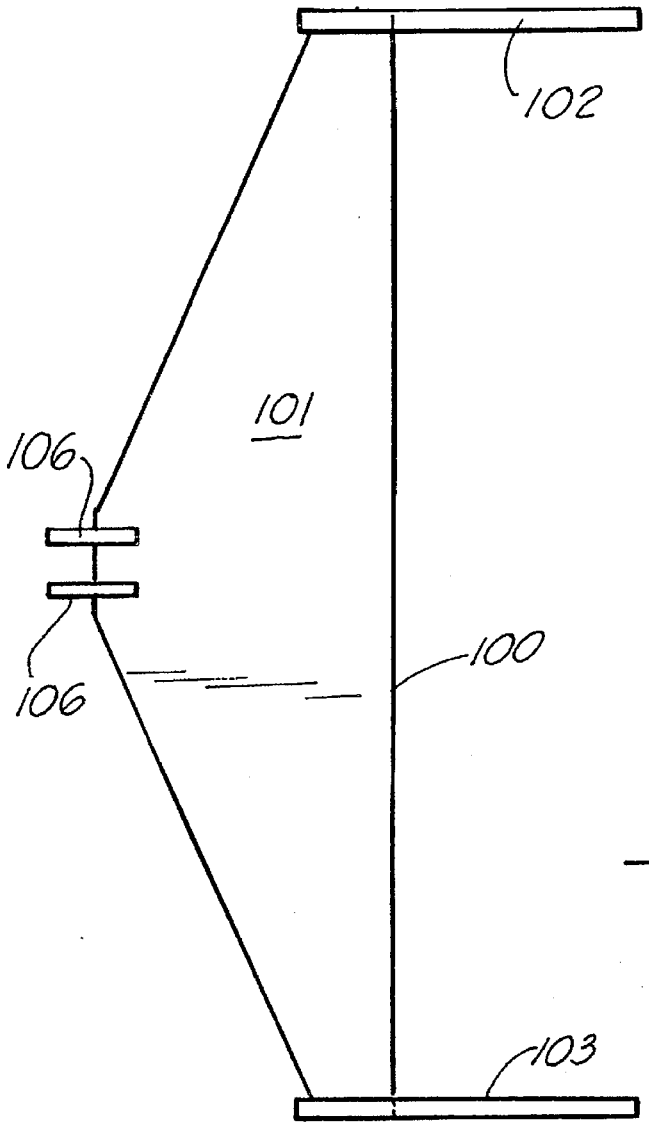
FIG. 8 is a fragmentary top view of the preferred embodiment of the apparatus of the present invention illustrating the spreader plate portion.
Figure 9:
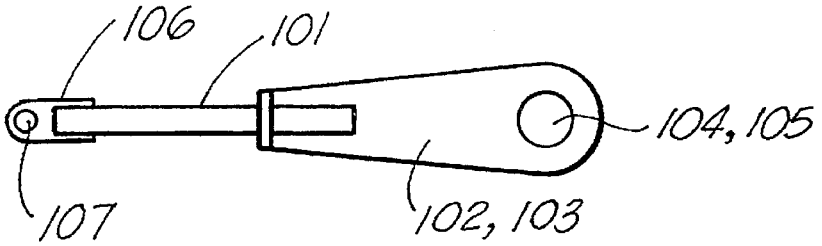
FIGS. 9 is a fragmentary side view of the spreader plate of FIG. 8.

In FIGS. 5 and 8–9, spreader plate 100 is shown more particularly. The spreader plate 100 includes a triangular plate section 101 with a pair of transverse plate members 102, 103 mounted to the end portions of the triangular plate 101 as shown in FIGS. 5 and 8. Each of the transverse plates 102, 103 provides an opening for attaching the spreader plate 100 at its openings 104, 105 to the barge padeyes 84. The openings 104, 105 thus provide a reference for alignment. When the openings 104, 105 are used to attach the spreader plate 100 to pin 83 at barge padeyes 84, this arranges the plates 103, 104 perpendicular to the central longitudinal axis of pin 83. Further, the padeyes 106 are spaced an equal distance from each of the transverse plates 102, 103 mainly at the center of triangular plate section 101. This arrangement centers the winch cable 95 and the sling 98 on the center of the winch 86.

During use, the winch 86 can thus be used to pay out or to pull in cable 95 thus determining the distance between each of the barges 11, 12 and the deck package 30 to be lifted. Further, it should be understood by an inspection of FIGS. 1 and 3, that the horizontal member 38 of deck package 30 is at the same elevation as the lower connections 52, 53. In this fashion, the deck package 30 itself carries the tensile load that is transmitted to the deck package 30 by the cable 95 and sling 98.

Figure 10:
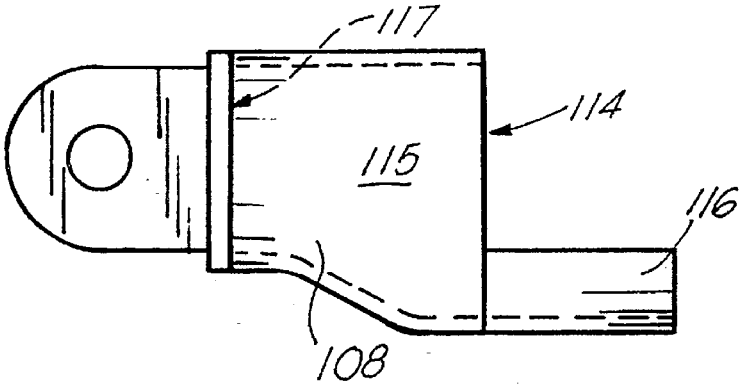
FIG. 10 is a fragmentary side view illustrating the bell connector portion thereof.
Figure 12:
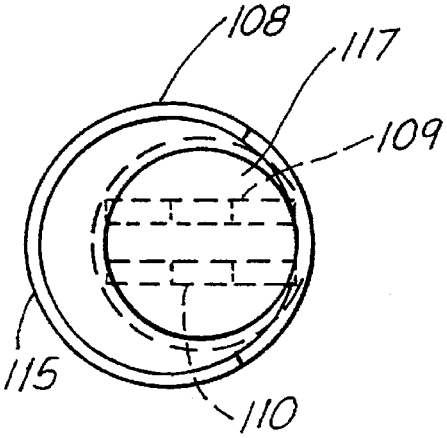
FIG. 12 is an end view of the bell connector of FIG. 10.
Figure 11:
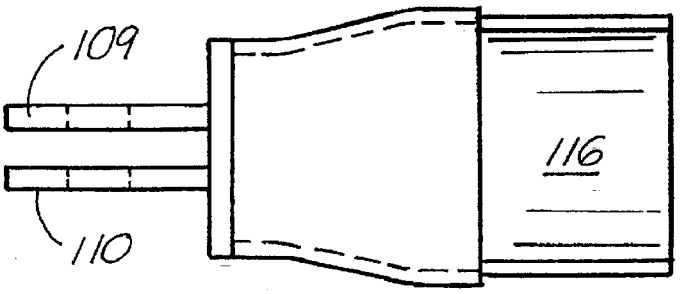
FIG. 11 is a top view of the bell connector of FIG. 10.

The present invention provides a quick connect, quick disconnect method and apparatus for forming a connection between each lifting boom 56–59 and the deck package 30. In FIGS. 1–4, there can be seen a bell connector 108 that is pinned to the deck package 30 at each of the upper connections 48–51. The bell 108 is shown more particularly in FIGS. 10–12. Each bell 108 provides a pair of padeyes 109, 110 each padeye 109, 110 provides an opening 111, 112 respectively. This opening allows a pinned connection to be formed between each bell connector 108 and a platform padeye 113. The padeye 108 provides a socket 114 that receives the cone end portion of each lifting boom 56–59. A surrounding side wall 115 is sized and shaped to conform and fit the conical end of each boom 56–59. A projecting curved wall portion 116 extends away from the portion 115 as shown in FIGS. 10 and 11. The curved wall portion 116 extends about 120° rather than a full 360° about wall 115. This allows the end portion 62 of each boom 56–59 to engage the member 116 as a point of reference before entering the socket 114. An end plate 117 extends transversely. The padeyes 113 are mounted to the end plate 117. The side wall 115 extends from the opposite side of end plate 117. The bell 108 can be of welded, structural steel construction. The socket 114 closely conforms in size and shape to the frustroconical tip 63 of each lifting boom 56–59. The plate end portion 65 of each lifting boom 56–59 bears against flat plate 117. In FIG. 1, each of the lifting booms 56–59 has engaged a bell connector 108.

The winch 86 can be used to lower a deck package 30 into position on a selected jacket 15. The winch 86 can also be used to raise a deck package 30 that is already supported upon a jacket 15. For example, obsolete or abandoned deck platforms 30 can be removed from a jacket 15 using the method and apparatus of the present invention as described above.

A first alternate embodiment is shown in FIG. 13. In FIG. 13, the deck package 30 is substantially the same in construction as the deck package described with respect to FIGS. 1–12. Thus, deck package 30 includes columns 31, 32 and diagonal members 39–42 as well as horizontal members 35–37. A deck 43 is provided.

A pair of barges 11, 12 are used to lift the deck package 30. In FIG. 13, the deck package is shown as it is being lifted from a transport barge 122. However, the same configuration shown in FIG. 13 could be used to lift the deck package from an underlying supporting jacket as with the embodiment of FIGS. 1–12. The transport barge 122 can include coles 123, 124 each having respective sockets 125, 126 for receiving a lower end of the columns 31, 32 of the deck package 30. In order to lift the deck package 30 from transport barge 122, lifting assemblies are shown as with respect to the embodiment of FIGS. 1–12. However, in FIG. 13, compression springs are located in the compression boom. Tension springs are located in the generally horizontal variable length member of the truss apparatus. In FIG. 13, the second embodiment of the apparatus is designated generally by the numeral 120. Each of the lifting booms 56–59 provides a compression spring 127, 128. Each of the variable length members of the truss apparatus 120 provides a tension spring 129, 130. The compression springs 127, 128 and the tension springs 129, 130 can be a spring, a rubber shock cell, or an elastomer. The compression springs 127, 128 and the tension springs 129, 130 cushion load transfer from dynamic seastate through the lifting apparatus 122 to each of the lifting barges 11, 12.

In FIGS. 14–15, the third embodiment of the apparatus of the present invention is shown designated generally by the numeral 131. In FIGS. 14–15, a pair of trapezoidal deck members 132, 133 are connected at center pin 134. A pair of lifting booms 56, 57 are mounted on the uppermost trapezoidal member 132 as shown in FIG. 14. The lifting booms, the winch 85, 86, the backstay 94, cable 95 and sheaves 96, 97 and all other related lifting equipment shown in FIG. 4 are the same in the embodiment of FIGS. 14 and 15. The only difference is that the equipment shown in FIGS. 1–12 is mounted on a barge 11 or 12. In the embodiment of FIGS. 14 and 15, that equipment is mounted directly upon the upper surface of trapezoidal member 132 as shown. As the barge 11 rotates about center pin 134, deck stress that produce a twist in the barge do to undesirable seastate is reduced or eliminated. The center pin 134 and the upper and lower trapezoidal sections 132, 133 provides an articulating system on one or both of the lifting barges 11 and 12 for the purpose of reducing stress on the decks. Such stress can be produced for example from "quartering swells" or other related undesirable seastates occasionally encountered during installation.

In FIG. 16, jackets 135, 136 are provided for preventing articulation between the upper trapezoidal section 132 and the lower trapezoidal section 133. The jackets 135, 136 can be used to rigidify the upper and lower trapezoidal sections 132, 133 relative to one another if calm seastates exist.

Figure 18:
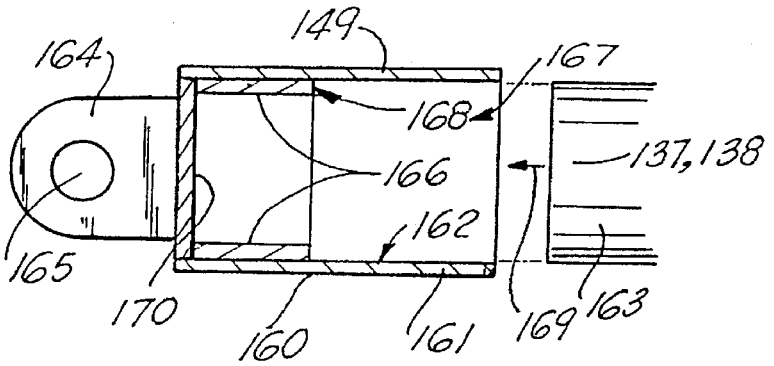
FIG. 18 is a fragmentary view of the alternate embodiment of FIG. 17.
Figure 17:
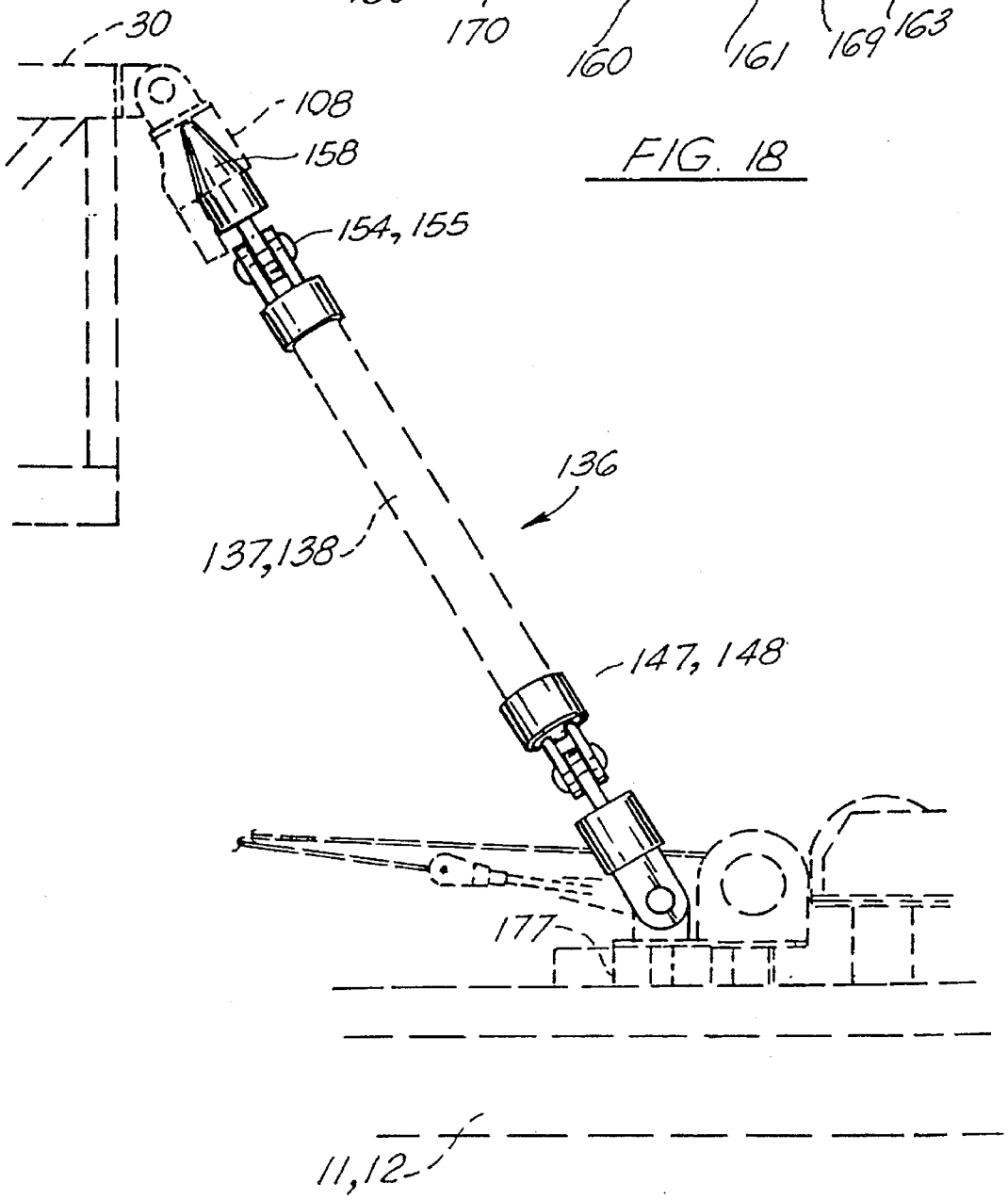
FIG. 17 is a perspective fragmentary view of an alternate embodiment of the apparatus of the present invention.
Figure 19:
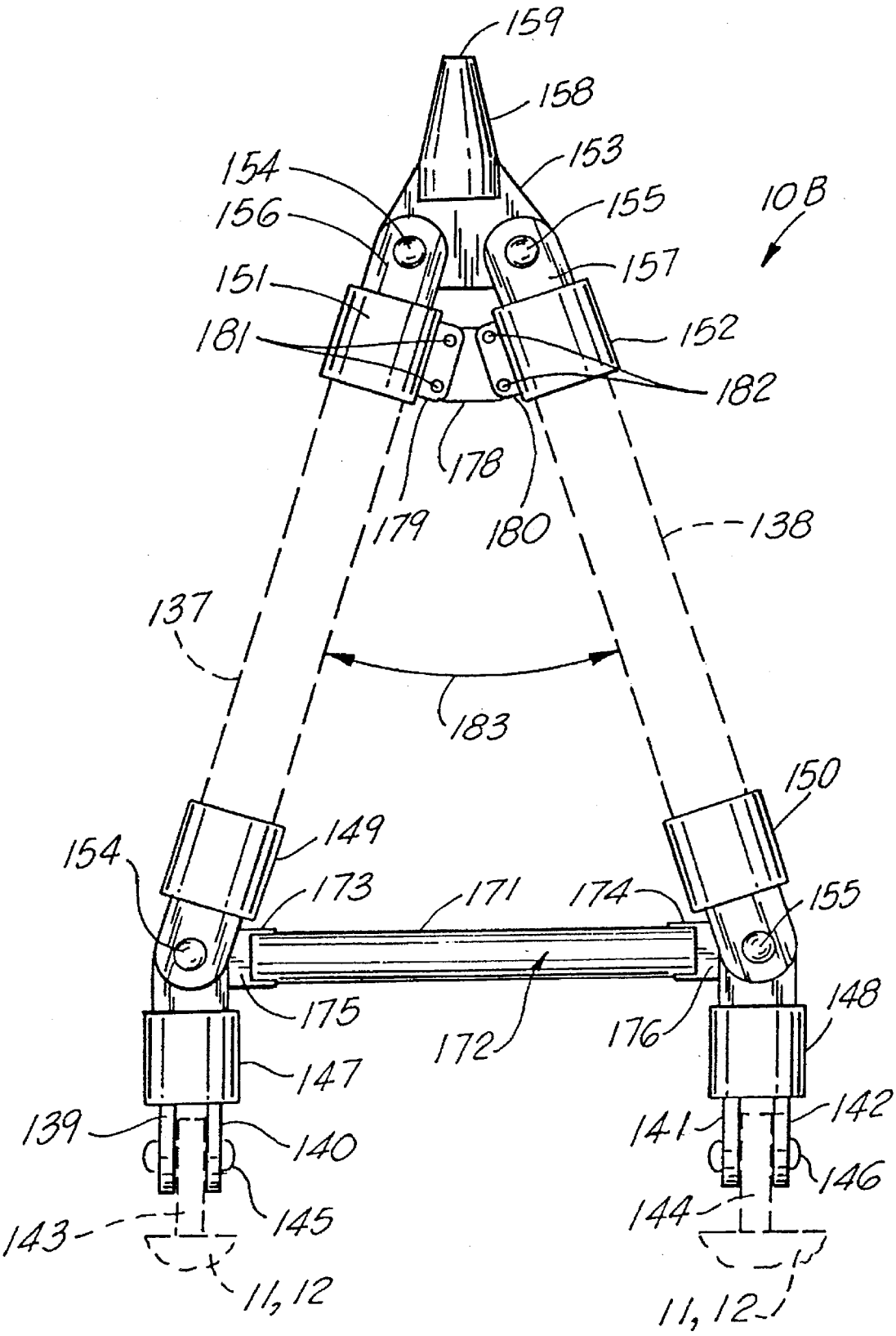
FIG. 19 is a top fragmentary view of alternate embodiment of FIGS. 17 and 18.

FIGS. 17–19, an alternate embodiment of the boom portion of the apparatus of the present invention is shown, designated generally by the numeral 10B in FIG. 17. Lifting apparatus 10B has a pair of longitudinally extending boom members 137, 138. These members 137, 138 are shown in phantom lines in FIGS. 17 and 19 and in hard lines in FIG. 18.

The longitudinal members 137, 138 of lifting boom 136 can be of a selected length because a removable connection is formed between each of the longitudinal members 137, 138 and a pair of end caps. In FIGS. 17 and 19, the longitudinal member 137 attaches at one end to end cap 151 and at its opposite end to end cap 149. Similarly, the member 138 attaches to end cap 152 at one end portion and at its other end portion longitudinal member 138 attaches to end cap 150. In FIG. 19, the end caps 149, 150 are connected via a pinned connection to padeye members 147, 148.

The padeye members 147, 148 attach to a load spreader 177 (FIG. 17) on the deck of a barge 11, 12. Each padeye member 147, 148 provides a pair of spaced apart padeyes. The padeye member 147 has a pair of padeye plates 139, 140, each having an opening that is receptive of a pin to form the pinned connection 145. Deck padeye 143 also provided an opening for accepting a pin to form pinned connection 145. The padeye member 148 has a pair of padeye plates 141, 142 that have openings for accepting a pin to form pinned connection 146. Deck padeye 144 also has an opening that is receptive of the pin 146.

During use, lifting apparatus 10A provides a boom that functions in the same manner as the boom shown in FIGS. 1–4 and 13–16. The difference between the embodiment 10B and that shown in FIGS. 1–4 and 13–16 is that the embodiment 10B is of an adjustable length. This adjustability is afforded by providing a longitudinal member 137, 138 of a desired length and forming a removable connection between each longitudinal member 137, 138 and its respective end caps 149–152 as shown in FIG. 19.

A structural plate 153 forms a connection with end caps 151, 152 at respective pinned connections 154, 155. The plate 153 has openings that accommodate pins for connecting gusset plates 156, 157 to plate 153 as shown in FIG. 19. The plate 153 carries a frustroconical tip portion 158 that forms a connection with a bell such as 108 when the apparatus 10B is used to form a lift such as that shown in FIGS. 1–4 or 13–16. As with the embodiment of FIG. 6, the frustroconical tip 158 can have a flat circular end 159.

The construction of the end caps 149–152 is shown more particularly in FIG. 18. While a single end cap 149 is shown for purposes of simplicity in FIG. 18, it should be understood that each of the end caps 149–152 is constructed in accordance with the drawing in FIG. 18. In FIG. 18, each end cap 149 has a cylindrically shaped portion 160 that includes a cylindrically shaped wall 161 having an inside surface 162 that is also cylindrically shaped. The inside surface 162 conforms to the configuration of the outside surface 163 of the longitudinally extending members 137, 138. Each end cap 149 has a flat plate 164 with an opening 165 that accommodates a connecting pin such as 144 or 145. A cylindrically shaped insert 166 can be provided inside the cylindrically shaped socket 167 as shown in FIG. 18. The cylindrically shaped insert 166 thus provides a stop surface 168 that limits the penetration of longitudinal member 137, 138 into socket 167 in the direction of arrow 169 as shown in FIG. 18.

In FIG. 19, cross support 171 can be used to rigidify the assembly of members 137, 138. Cross support 171 has a cylindrically shaped outer surface 172 and end portions 173, 174. The end 173 has a flat plate 175 and the end 174 has a flat plate 176. Each of the flat plates 175, 176 has an opening that receives a pin as shown in FIG. 17. This allows a pinned connection to be formed between the ends 173, 174 of cross support 171 and the end caps 149, 150 and the padeye members 147, 148. These pinned connections are designed as 154 and 155 in FIG. 19.

At the upper end of each longitudinal member 137, 138 a stabilizer plate 178 can be used to stabilize the assembly of the adjacent end caps 151, 152. The end cap 151 carries a flange 179 having openings that receive pins to form pinned connections 181 with plate 178. Similarly, the end cap 152 has a flange 180 that has openings to accept pins for forming pinned connections 182 with plate 178. Plate 178 would thus provide four openings to receive pins so that the pinned connections 181, 182 shown in FIG. 19 can be made. A desired angle 183 between members 137 and 138 can be formed be changing the length of cross support 171 and the geometry of plate 178 and the positions of its openings and that of pinned connections 181, 182.

An "A" frame lift boom can be formed by using the members 137, 138 and the end caps 149–152 but replacing the frustroconical portion 158 with a multi-sheave crown block.

The following table lists the parts numbers and parts descriptions as used herein and in the drawings attached hereto.

PARTS LIST

| Part Number | Description |
|---|---|
| 10 | lifting apparatus |
| 10A | lifting apparatus |
| 11 | barge |
| 12 | barge |
| 13 | water surface |
| 14 | seabed |
| 15 | jacket |
| 16 | base |
| 17 | exposed portion |
| 18 | column |
| 19 | column |
| 20 | column |
| 21 | column |
| 22 | horizontal member |
| 23 | horizontal member |
| 24 | horizontal member |
| 25 | horizontal member |
| 26 | socket |
| 27 | socket |
| 28 | socket |
| 29 | socket |
| 30 | deck package |
| 31 | column |
| 32 | column |
| 33 | column |
| 34 | column |
| 35 | horizontal member |
| 36 | horizontal member |
| 37 | horizontal member |
| 38 | horizontal member |
| 39 | diagonal member |
| 40 | diagonal member |
| 41 | diagonal member |
| 42 | diagonal member |
| 43 | deck |
| 44 | projection |
| 45 | projection |
| 46 | projection |
| 47 | projection |
| 48 | upper connection |
| 49 | upper connection |
| 50 | upper connection |
| 51 | upper connection |
| 52 | lower connection |
| 53 | lower connection |
| 54 | lower connection |
| 55 | lower connection |
| 56 | lifting boom |
| 57 | lifting boom |
| 58 | lifting boom |
| 59 | lifting boom |
| 60 | upper cylindrical portion |
| 61 | lower end portion |
| 62 | free end |
| 63 | frustroconical tip |
| 64 | frustroconical surface |
| 65 | flat end portion |
| 66 | boom longitudinal member |
| 67 | boom longitudinal member |
| 68 | boom transverse member |
| 69 | padeye |
| 70 | padeye |
| 71 | padeye |
| 72 | padeye |
| 73 | opening |
| 74 | opening |
| 75 | opening |
| 76 | opening |
| 77 | reference line |
| 78 | short section |
| 79 | short section |
| 80 | long section |

-continued

PARTS LIST

| Part Number | Description |
|---|---|
| 81 | long section |
| 82 | angle |
| 83 | pin |
| 84 | deck padeye |
| 85 | winch |
| 86 | winch |
| 87 | pedestal |
| 88 | pedestal |
| 89 | cable |
| 90 | sheave |
| 91 | padeye |
| 92 | sheave |
| 93 | padeye |
| 94 | backstay |
| 95 | cable |
| 96 | sheave |
| 97 | sheave |
| 98 | sling |
| 99 | padeye |
| 100 | spreader plate |
| 101 | triangular plate section |
| 102 | transverse plate |
| 103 | transverse plate |
| 104 | opening |
| 105 | opening |
| 106 | padeye |
| 107 | opening |
| 108 | bell |
| 109 | padeye |
| 110 | padeye |
| 111 | opening |
| 112 | opening |
| 113 | padeye |
| 114 | socket |
| 115 | side wall |
| 116 | member |
| 117 | end plate |
| 120 | lifting apparatus |
| 121 | water surface |
| 122 | barge |
| 123 | column |
| 124 | column |
| 125 | socket |
| 126 | socket |
| 127 | compression spring |
| 128 | compression spring |
| 129 | tension spring |
| 130 | tension spring |
| 131 | lifting apparatus |
| 132 | upper trapezoidal member |
| 133 | lower trapezoidal member |
| 134 | center pin |
| 135 | jack |
| 136 | lifting boom |
| 137 | longitudinal member |
| 138 | longitudinal member |
| 139 | padeye |
| 140 | padeye |
| 141 | padeye |
| 141 | padeye |
| 142 | padeye |
| 143 | deck padeye |
| 144 | deck padeye |
| 145 | pin |
| 146 | pin |
| 147 | padeye member |
| 148 | padeye member |
| 149 | end cap |
| 150 | end cap |
| 151 | end cap |
| 152 | end cap |
| 153 | structural plate |
| 154 | pin |
| 155 | pin |
| 156 | plate |
| 157 | plate |

-continued

PARTS LIST

| Part Number | Description |
|---|---|
| 158 | frustroconical section |
| 159 | flat surface |
| 160 | cylinder |
| 161 | cylindrical wall |
| 162 | inner surface |
| 163 | outer surface |
| 164 | plate |
| 165 | opening |
| 166 | cylindrical insert |
| 167 | cylindrical socket |
| 168 | stop |
| 169 | arrow |
| 170 | stop plate |
| 171 | cross support |
| 172 | cylindrical outer surface |
| 173 | end |
| 174 | end |
| 175 | plate |
| 176 | plate |
| 177 | load spreader |
| 178 | stabilizer plate |
| 179 | flange |
| 180 | flange |
| 181 | pinned connection |
| 182 | pinned connection |
| 183 | angle |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A lifting apparatus for placing a multi-ton deck package on an offshore jacket or partially submerged foundation, comprising:

a) a pair of barges, each defining a base that can support a large multi-ton load;

b) truss means supported by the barges about the periphery of the deck package for forming a load transfer between the barges and the deck package to be placed, said truss means including a plurality of diagonally extending lift booms, each lift boom having a lower end attached to a barge and an upper end which enables attachment to the deck package;

c) each boom comprising:

i) a pair of longitudinally extending members;

ii) a plurality of end caps that each removably connect to at least one longitudinally extending lift boom;

iii) the end caps forming part of the connection between the deck package and a barge;

d) upper and lower connection means for forming attachments of the truss means to the deck package at upper and lower respective elevational positions;

e) said upper and lower connection means including corresponding connecting portions that enable the barges and package to quick disconnect, one of said corresponding quick connecting portions including the upper end portion of the lifting boom, said other quick connecting portion being positioned at said upper elevational position; and f) means for lowering the combination of the truss means and the supported deck package with respect to the jacket or partially submerged foundation during placement of the deck package on the jacket or partially submerged foundation.

2. The apparatus of claim 1 wherein the truss means is a variable dimension truss means that includes a lifting boom and at least one truss member of variable length.

3. The apparatus of claim 1 wherein the barge includes two barges with horizontal surfaces spaced generally on opposite sides of the deck package being lifted during placement of the deck package on the jacket or partially submerged foundation.

4. The apparatus of claim 2 wherein the variable dimension truss means includes two opposing truss members that are each pinned to a different barge and which are angularly disposed with respect to each other during use, wherein the end caps form a detachable interface between the truss members and the barge.

5. The apparatus of claim 1 wherein the truss member of variable length includes a winch operated cable.

6. The apparatus of claim 1 wherein the upper connection means is a quick connect formed between a socket at the upper position on the deck package and the upper end portion of the lifting boom, the boom including two longitudinal members that detachably connect to the projection member.

7. The apparatus of claim 2 wherein the variable dimension truss means includes a winch operating a cable.

8. The apparatus of claim 1 wherein each lifting boom is an "A" frame shaped boom that comprises a pair of longitudinal boom members that form an acute angle, a pair of padeye members that form a detachable interface between each longitudinal boom member and a barge, a free end portion having a structural member with a projection thereon and a pair of end caps that form a detachable connection between the longitudinal boom members and the free end portion structural member.

9. The apparatus of claim 1 wherein the truss means includes multiple winch and cable assemblies on the upper deck surfaces of the barges.

10. A method for the offshore installation of a multi-ton prefabricated deck package on a jacket or partially submerged foundation, comprising the steps of:

a) transporting the prefabricated deck package to the site of the jacket or partially submerged foundation on a transport barge;

b) attaching a triangular truss-like lifting assembly to the deck package at multiple elevational positions on the deck package including positions that are at least on generally opposite sides of the deck package, and at upper and lower positions on the deck package respectively and at vertices of the triangular truss-like lifting assembly, the triangular truss-like lifting assembly including at least three chords, including a horizontal chord normally in tension during installation which has a variable length and a diagonally extending chord normally in compression during the lifting process;

c) wherein in step "b" the truss like lifting assembly has a plurality of removable end caps that attach to ends of the diagonally extending chord member and quick connect fittings are used to attach the diagonally extending chords to the deck package and to the end caps;

d) structurally supporting the triangular truss-like lifting assembly with one or more lift barges;

e) removing the transport barge as a support for the deck package so that the deck package is supported by the triangular truss-like lifting assembly and lift barges, with the deck package forming a load carrying portion of the triangular truss-like lifting assembly;

f) aligning the deck package with the jacket or partially submerged foundation so that the deck package can be placed on the jacket or partially submerged foundation; and g) lowering the deck package upon the jacket or partially submerged foundation by changing the length of the horizontal chord of each triangular truss like lifting assembly.

11. The method of claim 10, wherein the deck package is placed on the jacket or partially submerged foundation by lengthening the horizontal chord.

12. The method of claim 10, wherein the truss-like lifting assembly lowers the deck package during placement of the deck package on the jacket or partially submerged foundation.

13. The method of claim 10, wherein in step "f", the horizontal chord of the lifting assembly includes a winch that is wound with a lift cable which winds/unwinds to change the length of the cable.

14. The method of claim 10, wherein in step "d" the lift barges are floating barges.

15. The method of claim 10, wherein each lift barge has a winch structurally mounted thereon and the lower connection formed with the deck package includes a flexible cable extending between the winch and the deck package.

16. The method of claim 15, further comprising the step of connecting at least one end cap to the upper attachment position of the deck package.

17. A method for the offshore installation of a multi-ton prefabricated deck package on a jacket or partially submerged foundation, comprising the steps of:

a) transporting the prefabricated deck package to the site of the jacket or partially submerged foundation;

b) attaching a triangular truss-like lifting assembly to the deck package at multiple elevational positions on the deck package, including upper and lower positions that are at least on generally opposite sides of the deck package, said upper and lower positions being on the deck package respectively and at vertices of the triangular truss-like lifting assembly, the triangular truss-like lifting assembly including at least three chords, including a horizontal chord normally in tension during installation which has a variable length and a diagonally extending lifting boom normally in compression during lifting each boom including a pair of longitudinally extending members with end portions;

c) wherein in step "b" quick connect fittings are used to attach the diagonally extending lifting boom to end caps that are pinned to the deck package;

d) structurally supporting the triangular truss-like lifting assembly with one or more lift barges, the lifting boom being pivotally attached to a barge;

e) wherein the deck package is supported by the triangular truss-like lifting assembly and lift barges, with the deck package forming a load carrying portion of the triangular truss-like lifting assembly;

f) aligning the deck package with the jacket or partially submerged foundation so that the deck package can be placed on the jacket or partially submerged foundation; and g) lowering the deck package upon the jacket or partially submerged foundation by changing the length of the horizontal chord of the triangular truss-like lifting assembly.

* * * * *